United States Patent [19]

Decher et al.

[11] 4,240,057

[45] Dec. 16, 1980

[54] INDUCTIVE ELEMENT CONSTRUCTION, PARTICULARLY FLUORESCENT LAMP BALLAST

[75] Inventors: Friedrich Decher, Oberursel; Günther Bachorz, Urbach, both of Fed. Rep. of Germany

[73] Assignee: Firma Hermann SCHWABE, Urbach, Fed. Rep. of Germany

[21] Appl. No.: 67,339

[22] Filed: Aug. 17, 1979

[30] Foreign Application Priority Data

Aug. 19, 1978 [DE] Fed. Rep. of Germany ..... 2836401

[51] Int. Cl.[3] ..... H01F 27/26

[52] U.S. Cl. ..... 336/165; 336/178; 336/210; 336/212

[58] Field of Search ..... 336/165, 178, 134, 212, 336/210, 214, 215, 233, 234

[56] References Cited

FOREIGN PATENT DOCUMENTS

| | | | |
|---|---|---|---|
| 2223357 | 11/1972 | Fed. Rep. of Germany | 336/165 |
| 2055596 | 4/1975 | Fed. Rep. of Germany | 336/210 |
| 1306910 | 2/1973 | United Kingdom | 336/178 |

*Primary Examiner*—Thomas J. Kozma

*Attorney, Agent, or Firm*—Frishauf, Holtz, Goodman & Woodward

[57] ABSTRACT

To permit adjustment of the air gap of an inductance unit suitable as a ballast for fluorescent lamps particularly in form of a leakage transformer or as a choke, for multi-voltage connection, an outer, essentially U-shaped core structure (1, 100), and having an integral connecting cross element (1, 101*a*), and two parallel leg elements (1*b*, 101*b*), has at least one longitudinally slidable cross element (2, 2′, 2″; 3, 3′), the cross element being formed with a central longitudinal core element (14, 15; 14′, 14″) extending parallel to the leg elements, and short of the adjacent cross element, and longitudinally slidable within the leg elements so that the air gap between the longitudinal element and the adjacent cross element, and forming a magnetic shunt, can be adjusted after manufacture of the attached laminate to compensate for manufacturing tolerances and provide an inductance element having design impedance regardless of variation in the size of the longitudinal core element.

9 Claims, 4 Drawing Figures

FIG. 4
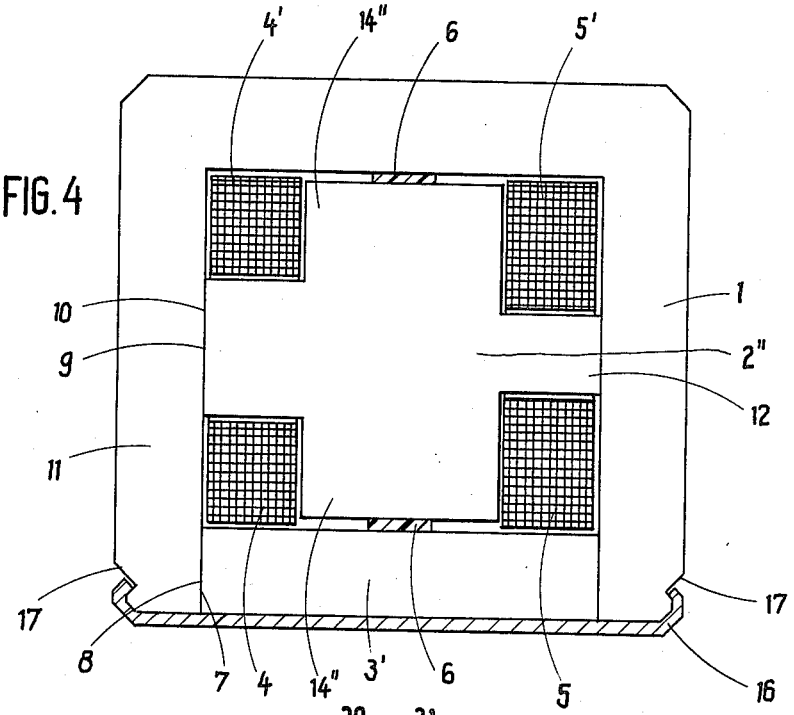
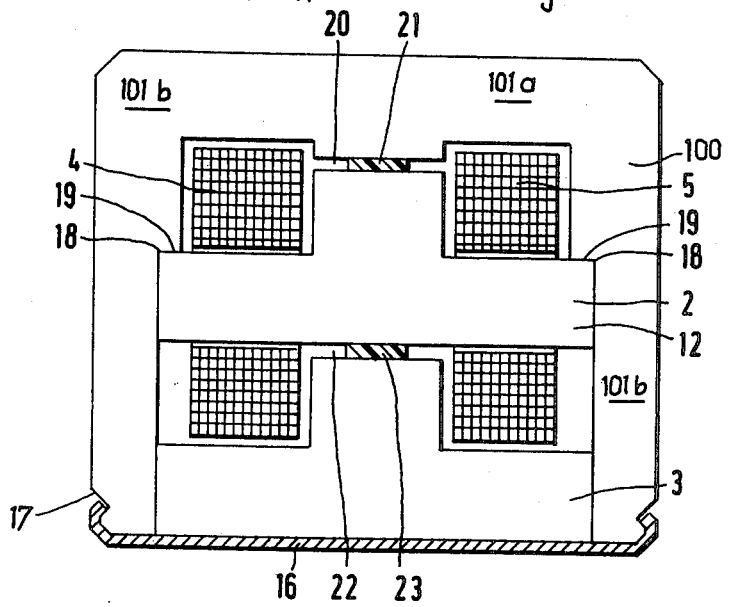
FIG. 3

INDUCTIVE ELEMENT CONSTRUCTION, PARTICULARLY FLUORESCENT LAMP BALLAST

The present invention relates to an inductive element, particularly a fluorescent lamp ballast, and more especially to such a ballast construction in which the inductive element can be used as a ballast choke for one voltage range and as a counter-phase connected transformer for another voltage range.

BACKGROUND AND PRIOR ART

It has previously been proposed to make ballast elements for fluorescent lamps by joining together several T-shaped parts, arranged as a laminar stack, into a U-shaped core which surrounds the windings of the ballast. The legs and cross elements of the T-shaped core elements are surrounded by the legs of the U-shaped outer core element, and the dimensions are so arranged that two air gaps are formed which, to maintain their dimensions, may be filled with non-magnetic materials. The entire assembly is usually held together by a clamping bar.

Inductive units with high magnetic leakage are used frequently in applications in which the relationship between no-load and full-load voltage of transformers cannot be established by the internal voltage drop of a transformer. Leakage inductance units with a surrounding core are frequently constructed in form of a transformer in which magnetic shunts are located between with windings. Such a construction can be used, for example, if the element is to be suitable for two-line voltages, for example for either 110 V or 220 V. When connected for 220 V, the two windings are connected such that the magnetic flux from the respective windings will buck each other, so that the overall effect will be that of a choke; when used for 110 V, the two windings are serially connected so that, with the same construction, a high magnetic leakage transformer is obtained. One construction of this type is described in German Pat. No. 2,055,596. In this construction, a U-shaped laminar stack surrounding core element surrounds a laminar central core which is constructed of two T-shaped core portions. The cross bar of the T-shaped core portion is slightly smaller than the dimension between the longitudinal legs of the U-shaped outer core. The surrounding outer core cross elements match to and fit on the internal surfaces of the longitudinal legs of the U-shaped surrounding core. The smaller dimension of the cross bar then leaves an air gap in the shunt. This arrangement results in air gaps of predetermined size. The core laminae usually are punched. To permit proper punching under mass production conditions, and to accomodate tolerances in manufacture, the air gap must have a certain minimum size. To obtain a predetermined design impedance of this inductive element, it is necessary to match the number of turns of the windings thereon, that is, of the two windings which may be termed primary and secondary windings, to the size of the air gap. The actual size of the air gap, however, will depend not only on the design size but also on the accuracy of manufacture and of the punching tool itself. This causes difficulty in mass production since, if a certain size of air gap is determined to be used with a certain number of windings, the design of the winding must be arranged to accomodate worst-case conditions when punching the lamellae or transformer sheets on which the windings are to be placed.

The dependence of a design parameter of the actual size of the air gap leads to increased cost in manufacture of such a high leakage inductance transformer, since more material than is actually necessary has to be provided for; additionally, testing and re-arranging of the number of turns of the windings as actual air gaps change increases the manufacturing time. An air gap of predetermined size has the disadvantage that, as the punching tool becomes worn, the actual air gap due to inaccurate punching will change from the design size thereof so that, to maintain the predetermined design impedance of the inductance unit, the number of turns of the windings has to be changed, since there is no possibility to change the air gap once the lamellae have been punched. The construction has the additional disadvantage that the windings are placed above each other, since their common winding axis is at right angles to the assembly surface of the inductance unit, which causes heating of the upper winding by current flowing through the lower one. Thus, the design of the windings must take into consideration the mutual heat transfer between the windings due to current flow therethrough.

THE INVENTION

It is an object to provide a magnetically high-leakage inductance unit, such as a high-leakage transformer or a choke suitable for use with fluorescent lamps, in which a predetermined design impedance can be obtained, within a wide range and smallest tolerance, by changing the size of the air gap, while keeping the number of turns of the windings constant.

Briefly, the air gaps are placed in the region of the ends of the longitudinal legs of the T-shaped core portions, and the cross elements thereof fit snugly against the inner surfaces of the legs of the surrounding U-shaped element. The inner T-shaped core portion is then arranged to be longitudinally slidable along the length of the legs of the U-shaped surrounding core, so that the air gap formed by the longitudinal element of the T-shaped core portion can be varied and adjusted after manufacture of the core elements themselves. The T-shaped element preferably is a separate central cross element positioned between the parallel leg elements of the surrounding U-shaped outer core structure, on which the windings are wound. To obtain the T-shape thereof, a central longitudinal core element is formed integral with the separate central cross element and extending parallel between the leg elements, the central longitudinal core element terminating short of engagement with a least the facing cross element forming the surrounding core structure, to thereby leave an air gap, the size of which can be accurately determined.

The term "air gap" as used herein need not necessarily actually be a gap with air therebetween; to maintain the size thereof under operating conditions, and prevent any change, it may be filled with non-deformable or deformable elastic non-magnetic material, such a potting compound, silicone rubber, or the like.

DRAWINGS

Illustrating preferred examples:

FIG. 3 is a view similar to FIG. 1 and illustrating a third embodiment; and

FIG. 4 is a view similar to FIG. 1 and illustrating yet another embodiment.

Figure 1:
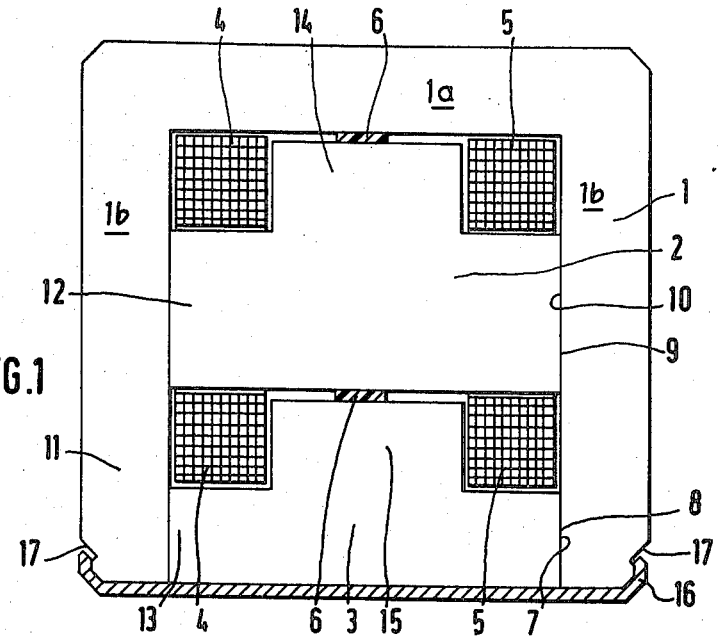
FIG. 1 is a longitudinal part-schematic sectional view of a first embodiment.

A U-shaped outer core structure 1 (FIG. 1) has two parallel leg elements 1*b* and a cross element 1*a*. The U-shaped core structure consists of a stack of punched sheets of transformer iron or the like, as well known and as standard for fluorescent lamp ballasts.

The U-shaped core structure 1 surrounds likewise laminar T-shaped core elements 2, 3. The laminar T-shaped core element 2 has a transversely extending cross portion 12. The closing cross element 3 has a transversely extending portion 13. Integral with the portions 12, 13, respectively, are central longitudinal portions 14, 15, extending parallel to the U-shaped legs 1*b* of the outer core structure 1. The cross portion 12 of the cros element core 2 has the two windings 4, 5 wound thereover, one of them forming the primary and the other the secondary winding. Since the structure is a leakage transformer with enclosed core, the cross section of the cross portion 12 carrying the windings 4, 5 is substantially larger than the cross section of the cross portion 13 of the cross element 3 and of the cross portion 1*a* of the core 1. To match the magnetic circuit, the cross section of the portion 12 can be twice as great as that of portions 1*a* and 13, respectively. The cross portion 13 of the core 3 closes the magnetic circuit and forms the closing leg of the surrounding core structure. The end surfaces 7, 9 of the cross elements 3, 2 fit snugly against the inner surfaces 8, 10 of the legs 1*b* of the U-shaped surrounding core 1, to form a complete closed magnetic circuit. The longitudinal core element portions 14, 15, forming the central legs of the T-elements 2, 3, form the magnetic shunt paths.

The air gaps are formed between the longitudinal core elements 14, 15 and adjacent cross portions 1*a* and 12. Their sizes are defined by non-magnetic inserts 6. At least one of the inserts 6, preferably, consists of deformable material so that, after assembly and upon testing the impedance of the unit, the air gap can be adjusted by longitudinally sliding the respective element 2, 3. The assembly is held together by a cross bar 16, as standard in such constructions, after the longitudinal position of the respective T-shaped cross elements 2, 3 has been adjusted. The cross bar 16 fits into grooves 17 formed at the outer edge of the legs 1*b* of the core structure 1, and is held therein by tension, thus clamping the T-shaped elements 2, 3 in fixed position and pressing them against the respective air gap inserts 6 and in the direction of the cross bars 1*a* of the U-shaped core structure 1.

Figure 2:
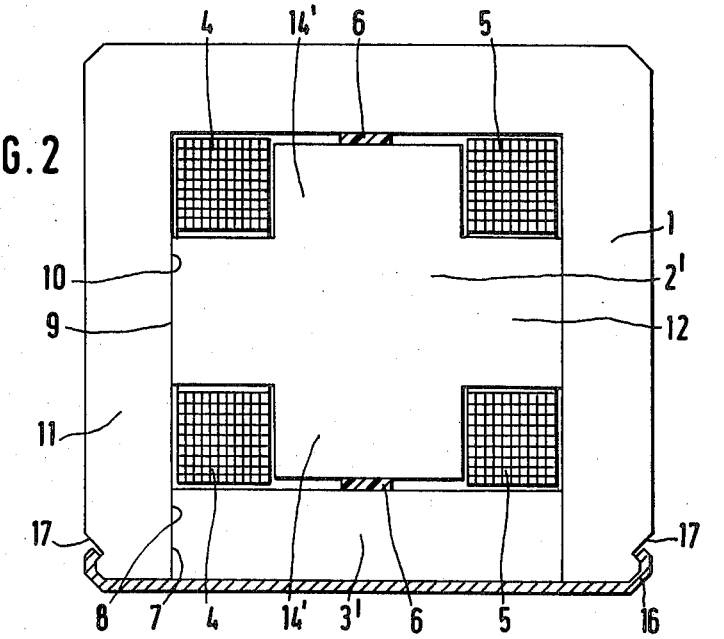
FIG. 2 is a view similar to FIG. 1 and illustrating a second embodiment.

The particular shape of the cross elements can be varied and the longitudinal core elements 14, 15 can be placed as desired. FIG. 2 illustrates an embodiment in which the cross element 2′ is generally cross-shaped, and the windings 4, 5 are arranged at opposite sides of the longitudinal cross element 14′ extending from the cross portion 12 in both directions. Thus, both magnetic shunt paths are formed at the single longitudinal portion 14′. The closing cross element 3′ is merely a straight cross connection to close the surrounding magnetic circuit.

The structures of FIGS. 1 and 2 permit any desired adjustment of the size of the air gap, and thus permit an economically optimal solution to the dimension of the inductance unit. The design of the winding can be independent of variations of the air gap from a design value, since the air gap can be adjusted after manufacture of the core elements and the windings thereon to design specifications. By deformation of one or the other, or both of the air gap inserts 6, the impedance of the unit can be adjusted accurately to meet design specifications.

Embodiments of FIG. 3: The structure is basically the same as that of FIG. 1, although the central cross element may be cross-shaped as in FIG. 2. The core portion 2, however, which carries the windings 4, 5, is fitted with its lateral end portions 18 against matching shoulders 19 formed in the legs 101*b* of the core 100. This determines the width of the upper air gap 21, since the core element 2 cannot be moved upwardly against the cross element 101*a* of the surrounding core 100. The air gap insert 21 thus can be made of non-deformable stiff material since the width of the air gap 20 is fixed. The lower cross element 3, however, is upwardly slidable to vary the width of the air gap 22 by deformation of the deformable air gap insert 23 so that, by changing the air gap 22, the overall impedance of the inductance unit can be adjusted. The cross element 3 is maintained in its adjusted position, as in the other embodiments, by the cross bar 16, clamped into grooves 17, and held therein under stressed conditions.

In FIG. 4 the structure is basically the same as that of FIG. 2, the central core element 2″ being cross shaped. The effective magnetic cross section of the core element 2″, however, is smaller in the region of the winding 5′ than that in the region of the winding 4′. The dimensioning depends on the relation of the no-load-voltage to the load-voltage. By reducing the effective magnetic cross section of the core element in the region of the winding 5′ the magnetic circuit is reduced, causing a saving in materials and an enlargement of the winding space.

Various changes and modifications may be made, and features described in connection with any one of the embodiments may be used with any of the others, within the scope of the inventive concept.

I claim:

1. Inductive element construction, particularly for a fluorescent lamp ballast or transformer, comprising an outer, essentially U-shaped core structure (1, 100) of one-piece construction having a connecting cross element (1*a*, 101*a*) and two parallel leg elements (1*b*, 101*b*);

a separate closing cross element (3, 3′) positioned between the open ends of the parallel leg elements and in magnetically coupled engagement therewith, to form a closed outer magnetic circuit;

a separate central cross element (2, 2′, 2″) positioned between the parallel leg elements (1*b*, 101*b*) and located intermediate the connecting cross element (1*a*, 101*a*) and the closing cross element (3, 3′);

central longitudinal core elements (14, 15, 14′, 14″) extending parallel to said leg elements (1*b*, 101*b*) and being located intermediate the longitudinal extend of said cross elements, and electrical winding means (4, 5) wound over one of said central core elements, wherein, in accordance with the invention, the central longitudinal core elements (14, 15, 14′, 14″) terminate short of engagement with at least one of the facing cross elements to form at least one air gap (6, 20, 22) therewith, at least one central longitudinal core element being integral with one of said separate cross elements, said one separate cross element being longitudinally slidably positionable with respect to an adjacent parallel leg element to permit adjustment of the width of the air gap;

and wherein the outer end face surfaces (7, 9) of said separate core elements are in magnetically coupled engagement with the inner facing surfaces (8, 10) of the parallel leg elements (1*b*, 101*b*) to form a contacting magnetic circuit therewith.

2. Construction according to claim 1, wherein the central core elements (14, 15, 14', 14'') extend short of engagement with two facing cross elements to form two air gaps, and wherein the widths of the air gaps are different.

3. Construction according to claim 1, further comprising non-magnetic inserts (6, 21, 23) located in the air gaps to define the widths thereof.

4. Construction according to claim 3, wherein the thicknesses of the non-magnetic inserts are different.

5. Construction according to claim 3, wherein one of the non magnetic inserts comprises rigid material, and the other comprises a deformable material.

6. Construction according to claim 1, wherein (FIG. 2) the separate central cross element (2') and the longitudinal core element (14') are an integral unit of generally cross shape.

7. Construction according in claim 1, wherein (FIGS. 1 and 3) the separate central cross element (2) and the separate closing elements (3) each are integral with a longitudinal core element (14, 15) and each is of generally T-shape.

8. Construction according to claim 1, wherein the winding means comprises two windings (4, 5) wound about outer end portions of the separate central cros element (2, 2', 2'') and separated from each other by the longitudinal core elements (14, 15, 14').

9. Construction according to claim 1, wherein the winding means (4, 5) comprises two windings wound about the central core element;

and wherein the cross section of the central core element in the region of one of the windings has an effective magnetic cross section which differs from that in the region of the other of the windings.

* * * * *